United States Patent [19]

Flugan

[11] Patent Number: 4,567,404

[45] Date of Patent: Jan. 28, 1986

[54] BALLAST CIRCUIT HAVING ELECTROMAGNETIC INTERFERENCE (EMI) REDUCING MEANS FOR AN IMPROVED LIGHTING UNIT

[75] Inventor: David Flugan, Hudson, Ohio

[73] Assignee: General Electric Company, Schenectady, N.Y.

[21] Appl. No.: 562,919

[22] Filed: Dec. 19, 1983

[51] Int. Cl.[4] ..... H05B 37/00; H05B 39/00; H05B 41/14

[52] U.S. Cl. ..... 315/205; 315/DIG. 5; 315/DIG. 7; 315/127; 333/181; 363/40; 363/44; 363/46

[58] Field of Search ..... 333/181, 182; 315/DIG. 5, DIG. 7, 127, 205; 363/40, 44, 45, 46, 76

[56] References Cited

U.S. PATENT DOCUMENTS

| | | | |
|---|---|---|---|
| 3,982,173 | 9/1976 | Berry et al. | 363/76 |
| 3,987,356 | 10/1976 | Steigerwald | 363/44 |
| 4,176,310 | 11/1979 | Elenga et al. | 363/39 |
| 4,350,930 | 9/1982 | Peil et al. | 315/DIG. 7 |
| 4,412,279 | 10/1983 | Franklin | 363/44 |

*Primary Examiner*—Saxfield Chatmon

*Attorney, Agent, or Firm*—John P. McMahon; Philip L. Schlamp; Fred Jacob

[57] ABSTRACT

Various circuit embodiments for reducing the electromagnetic interference (EMI) typically created by a ballast circuit for an improved lighting unit is disclosed. The EMI reducing circuit adapts the operation of the source of the EMI of the ballast circuit to the conductive states of the rectifier means of the improved lighting unit.

6 Claims, 3 Drawing Figures

BALLAST CIRCUIT HAVING ELECTROMAGNETIC INTERFERENCE (EMI) REDUCING MEANS FOR AN IMPROVED LIGHTING UNIT

BACKGROUND OF THE INVENTION

The present invention relates to a ballast circuit for gas discharge lamps. More particularly, the present invention relates to a ballast circuit having means for reducing electromagnetic interference (E.M.I.).

Recent improvements to the incandescent lamp art have provided an improved lighting unit having a highly efficient gas discharge tube as a main light source and an incandescent filament as a supplementary light source. Such an improved lighting unit is generally described in U.S. Pat. No. 4,350,930 of Piel et al, issued Sept. 21, 1982.

The gas discharge tube may be successfully operated by a ballast circuit developing a D.C. operating voltage for the gas discharge tube. Such ballast circuits are described in the previously mentioned U.S. Pat. No. 4,350,930 and also U.S. Pat. No. 4,320,325 of T. E. Anderson, issued Mar. 16, 1982.

The gas discharge tube has various modes of operation such as, (1) an initial high voltage breakdown mode, (2) a glow-to-arc transition mode, and (3) a steady state run mode. A ballast circuit, such as described in U.S. Pat. No. 4,350,930 for operating the gas discharge tube has an operating circuit having a starting circuit which employs a triggering oscillator that provides the necessary voltages so as to transition the gas discharge tube from its (1) initial high voltage breakdown mode, (2) to its glow-to-arc mode, and then (3) its steady state run mode.

The starting circuit due to its triggering oscillator typically generates a relatively high spiked pulse signal, which, in turn, typically generates a commonly known electromagnetic interference (E.M.I.) signal that is coupled onto the A.C. line supplying the incandescent unit and is manifested, for example, as a distracting signal which affects television viewing.

Filtering circuits that reduce or even substantially eliminate the electromagnetic interference type signals are well known. E.M.I. filters typically comprise an inductor-capacitor parallel arrangement. EMI filters employed for relatively low frequency applications, such as 50 to 60 Hz, require relatively large values for the inductor and capacitor circuit elements. The relatively large values of capacitors and inductors, in particular the large inductors, are disadvantageous with regard to the placement of these inductors within the housing of a relatively small device such as an improved lighting unit. It is desired that means be provided for an improved lighting unit that reduces the electromagnetic interference without the need of employing relatively large values of inductive and capacitive circuit elements.

Accordingly it is an object of the present invention to provide means for reducing electromagnetic interference without the use of inductors and enabling use of relatively small capacitors.

These and other objects of the present invention will become more apparent upon consideration of the following description of the invention.

SUMMARY OF THE INVENTION

The present invention is directed to an improved lighting unit having a ballast circuit for a gas discharge tube that is particularly suited for reducing electromagnetic interference.

The lighting unit has the gas discharge tube as its main light source, a filament serving as a supplementary light source and as a resistive ballast element, and a ballast circuit comprising means for disabling the coupling of conduction inducing triggering pulses to the gas discharge tube. The ballast circuit is adapted to accept across its first and second input terminals an applied alternating current (A.C.) voltage. The first and second input terminals have thereacross a rectifying means comprising four diodes arranged in a full-wave configuration and having at its output stage a filter capacitor. An improvement to the ballast circuit of the present invention comprises a control means and an interrupt means. The control means is effective for developing an output signal indicative that at least one of the diodes of the rectifying means is in a forward-biased condition. The interrupt means is responsive to the output signal of the control means and is effective for generating a disabling signal to inhibit the coupling of the conduction inducing triggering pulses to the gas discharge tube.

The subject matter which is regarded as the invention is particularly pointed out and distinctly claimed in a concluding portion of the specification. The invention, however, both as to its organization and its method of operation, together with further objects and advantages thereof, may best be understood by reference to the following description taken in conjunction with the accompanying drawings.

DETAILED DESCRIPTION OF THE PREFERRED EMBODIMENTS

Figure 1:
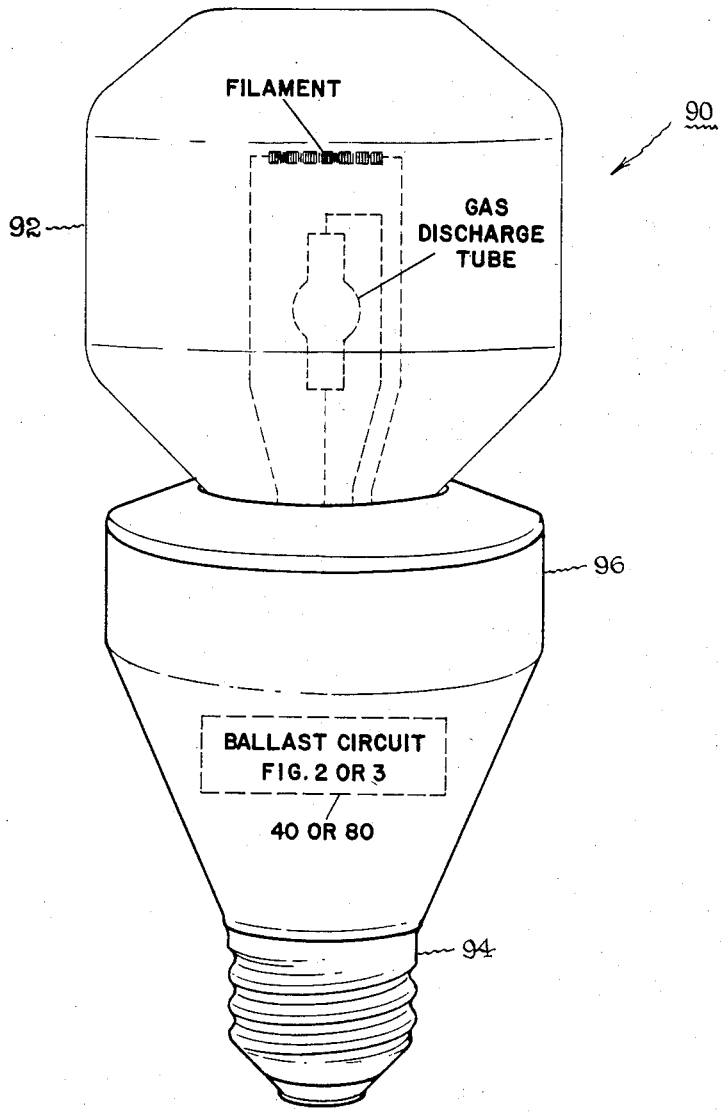
FIG. 1 shows a lighting unit in accordance with the present invention.

FIG. 1 shows a lighting unit 90 having a gas discharge tube (shown in phantom) as its main light source, and a filament (also shown in phantom) serving as a supplementary light source and as a resistive ballast element. The filament is spatially disposed within a light-transmissive outer envelope 92. The gas discharge tube of unit 90 may be a low voltage highly efficient type such as disclosed in U.S. Pat. No. 4,161,672 of D. M. Cap and W. H. Lake, issued July 17, 1979. The lighting unit 90 has an electrically conductive base 94 and a housing 96 for lodging the electrical elements of the ballast circuit 40 or 80 shown in FIGS. 2 or 3, respectively.

Figure 2:
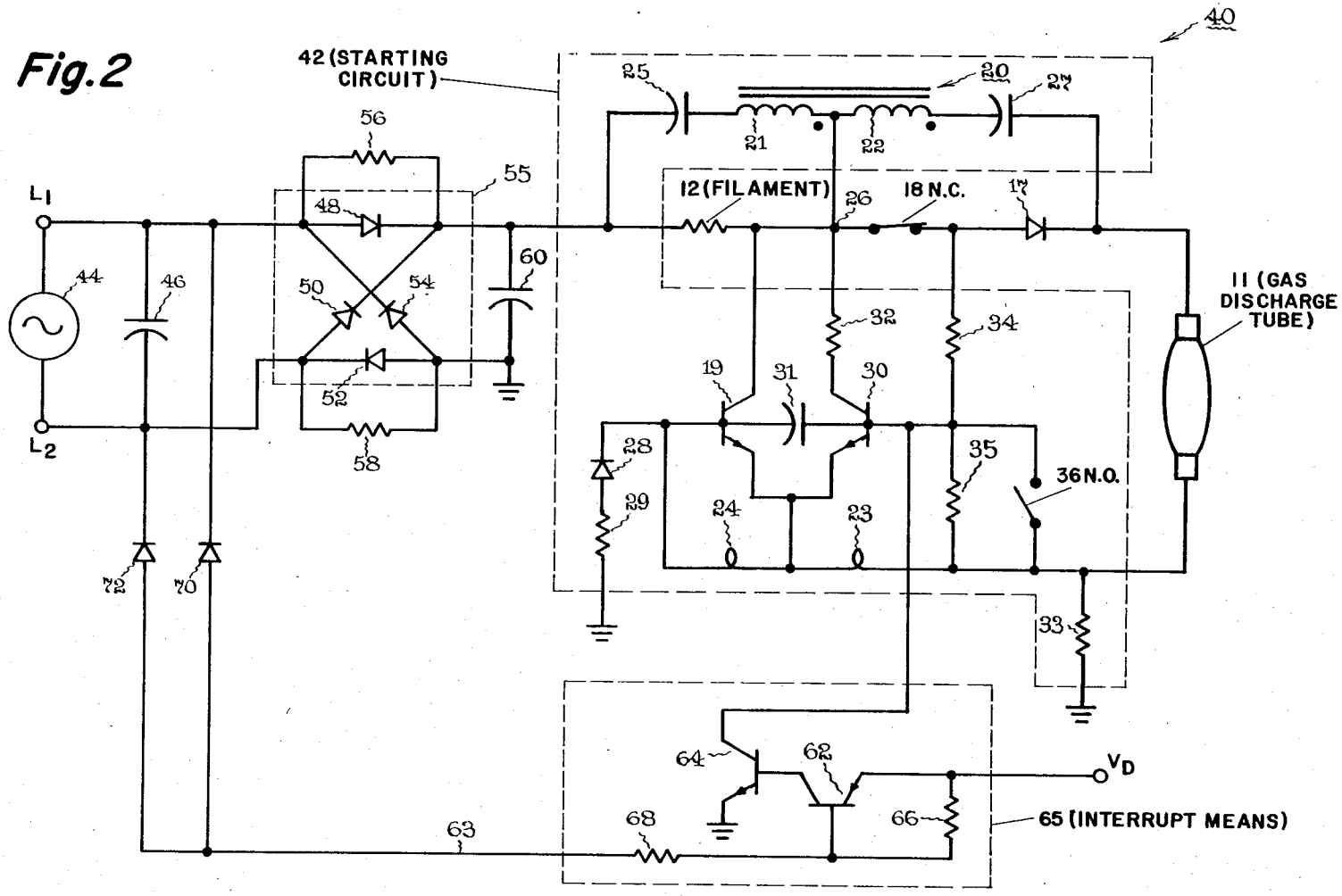
FIG. 2 is a circuit arrangement in accordance with one embodiment of the present invention.

FIG. 2 shows a ballast circuit 40 which is adapted to accept across its first and second input terminals L1 and L2, respectively, having appropriate connections (not shown) to the electrically conductive base 94, an A.C. source 44 having a typical value of 120 volts at a frequency of 60 Hz.

The circuit arrangement 40 includes a starting circuit 42 which is responsive to interrupt means 65 for disabling the coupling of conduction inducing triggering pulses to the gas discharge tube 11. The circuit arrangement 40 further has rectifying means 55 connected across the first and second terminals. The ballast circuit preferably has a first capacitor 46 connected across its first and second input terminals input stage. The rectifying means 55 has a second capacitor 60 connected across its output stage. The rectifying means 55 comprises a plurality of diodes 48, 50, 54, and 52 arranged in a full-wave rectifier configuration. In the circuit arrangement 40 two of the diodes, such as 48 and 52, are both forward biased during the same portion of the cycle of the applied alternating (A.C.) voltage 44 and each preferably have a resistive element 56 and 58, respectively, connected in parallel. The interrupt means 65 is responsive to an output signal developed by voltage sensing control means, shown in FIG. 2 as diodes 70 and 72, and which is applied to a conductor 63 serving as an input terminal to the interrupt means 65. As will be described, the output signal developed by the control means is indicative that at least one of the diodes 48 . . . 52 is in a forward-biased condition. As will be further described hereinafter, the interrupt means 65 in response to the signal applied to conductor 63 generates an output signal applied to a connection 67, which serves as a disabling signal to inhibit the starting circuit 42 from generating conduction inducing triggering pulses to the gas discharge tube 11.

Starting circuit 42 of FIG. 2 is comprised of a plurality of elements each having the same reference number, circuit arrangement, and description as given in U.S. Pat. No. 4,350,930 of W. Piel et al, which is herein incorporated by reference. Table 1 lists the reference number of the elements of the starting circuit 42 and also U.S. Pat. No. 4,350,930 along with the value or type of element.

TABLE 1

| Reference Numbers | Element Value or Type |
|---|---|
| 17 | Diode GI RGP-01 |
| 18 | Normally closed switch |
| 19 | Transistor-MJE 130005 |
| 20 | Ferrite autotransformer |
| 21 | Winding of transformer 20 |
| 22 | Winding of transformer 20 |
| 23 | A feedback winding of autotransformer 20 |
| 24 | A feedback winding of autotransformer 20 |
| 25 | Capacitor of 0.033 microfarads |
| 26 | Interconnection terminal |
| 27 | Capacitor of 0.004 microfarads |
| 28 | Diode IN914 |
| 29 | Resistor of 20 Ω |
| 30 | Transistor 2N6517 |
| 31 | Capacitor of 0.0047 microfarads |
| 32 | Resistor of 1K Ω |
| 33 | Resistor of 2 Ω |
| 34 | Resistor of 180K Ω |
| 35 | Resistor of 1K Ω |
| 36 | Normally-opened switch |

The circuit arrangement 40 also has a plurality of elements having reference numbers and of the value or type given in Table 2.

TABLE 2

| Reference Numbers | Component Value or Type |
|---|---|
| 46 | Capacitor of 0.1 microfarads |
| 48,50,52,54 | Diodes of Type IN5060 |
| 56 | Resistor of 10 M Ω |
| 58 | Resistor of 10 M Ω |
| 60 | Capacitor of 50 microfarads |
| 62 | Transistor of type 2N3906 |

TABLE 2-continued

| Reference Numbers | Component Value or Type |
|---|---|
| 64 | Transistor of type 2N3904 |
| 66 | Resistor of 5.6K Ω |
| 68 | Resistor of 100K Ω |
| 70,72 | Diodes of type IN914 |

The starting circuit 42 of FIG. 2 generates the necessary voltages so as to transition the gas discharge tube 11 from its (1) initial state requiring a relatively high applied voltage to cause an initial arcing condition of the gas discharge tube, (2) to its glow-to-arc state, and then (3) its final steady state run condition. Further details of the operation of the starting circuit 42, having the elements of U.S. Pat. No. 4,350,930, are described in U.S. Pat. No. 4,350,930.

As discussed in the "Background" section, starting circuits, such as starting circuit 42, due to their triggering oscillating mode of operation may cause electromagnetic interference (EMI) to be injected onto the A.C. power source 44 supplying the improved lighting unit 10. This EMI may typically be manifested as annoying interference bothersome, for example, to the television watching.

This interconnecting path for the source of the EMI, that is starting circuit 42, back onto the power source 44 is the rectifying means 55. The diodes 48, 50, 52, and 54 of the rectifying means 55 conduct current from the A.C. line 44 to the second capacitor 60 for about 30% of each cycle of the A.C. line. Whenever any of the diodes 48, 50, 52, and 54 are in a forward biased condition, the diodes 48, 50, 52, and 54 become low resistance paths for the EMI generated by starting circuit 42 back onto the power source 44 without encountering any or a small amount of attenuation.

Figure 3:
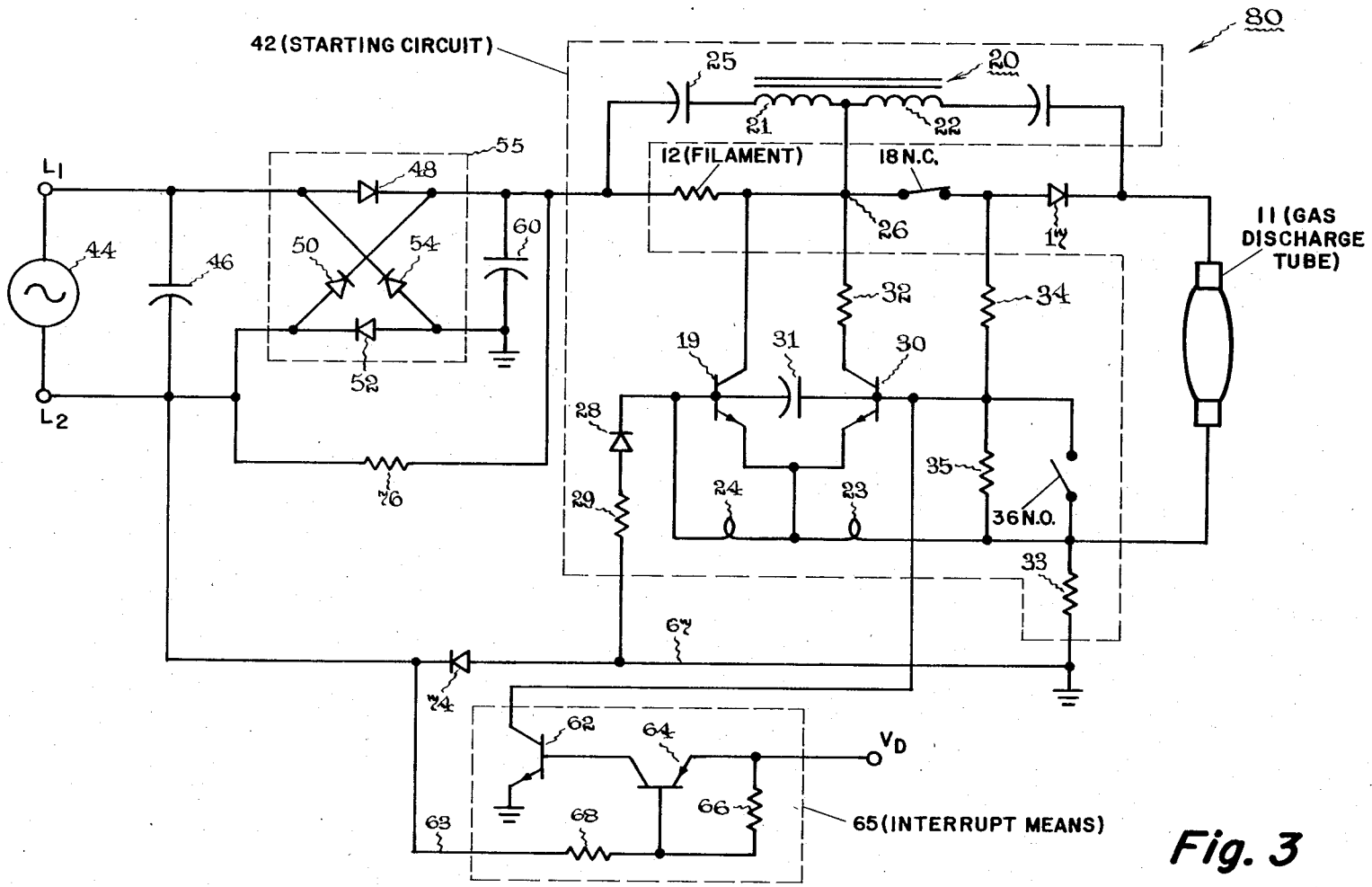
FIG. 3 is a circuit arrangment in accordance with another embodiment of the present invention.

An important feature of the present invention of the circuit arrangement 40 of FIG. 2, and also circuit arrangement 80 of FIG. 3, is to adapt or conform the operation of the starting circuit 42 to the conductive states of the diodes 48, 50, 52, and 54. In general, the circuit arrangement 40 operates so that the starting circuit 42, having the oscillating triggering pulses, is disabled or inhibited when any of the diodes 48, 50, 52, and 54 are in a forward-biased condition and conversely the starting circuit 42 is enabled so as to couple triggering pulses to the gas discharge tube 11 when all the diodes 48, 50, 52, and 54 are in a reverse biased condition. The diodes 48 and 52 are in their forward-biased condition when the A.C. source 44 renders terminal L1 with a positive polarity with respect to the terminal L2. Diodes 50 and 54 are in a forward-biased condition when A.C. source renders the terminal L2 with a positive potential with respect to terminal L1. The A.C. source 44 provides an alternating current that reverses its directions from positive to negative at regularly recurring intervals or cycles.

The circuit arrangement 40 has a voltage sensing control means comprised of diodes 70 and 72 for determining the voltage conditions of both the A.C. power source 42 and the capacitor 60. The voltage sensing means diodes 70 and 72, in response to a first condition where the voltage of the power source 44 is greater than the voltage across capacitor 60, apply a voltage on conductor 63 which is of a sufficient magnitude, such as −0.6 volts, so as to be responded to by interrupt means 65, which, in turn, inhibits the operation of starting circuit 42. The −0.6 volts is the voltage appearing at the cathode of diode 72 due to the forward-biased condition of diodes 48 and 52. Similarly, −0.6 volts is the voltage appearing at the cathode of diode 70 due to the forward-biased condition of diodes 50 and 54. For this first condition at least one of the diodes 48, 50, 52, and 54 are in a forward-biased condition and thus should not be allowed to provide a low resistant path for the EMI that may be generated by the starting circuit 42 to be injected onto the power source 44. Conversely, the voltage sensing means diodes 70 and 72, in response to a second condition where the voltage of the power source 44 is less than the voltage across capacitor 60, does not apply a voltage, such as more positive than 0.5 volts, onto conductor 63 of a sufficient magnitude to be responded to by interrupt means 65 so that the starting circuit 42 is allowed to apply conduction inducing triggering pulses to the gas discharge tube 11. The voltage of more positive than 0.5 volt is the voltage appearing at the cathode of diode 74 or 70 due to the reversed-biased condition of the diodes 48, 50, 52 and 54. For this second condition all of the diodes 48, 50, 52, and 54 are in a reversed-biased condition and thus all provide a high resistant path to the power source 44 for the EMI that may now be generated by the starting circuit 42.

The transistors 62 and 64 of interrupt means 65 in response to the voltage, such as about −0.6 volts developed by voltage sensing means diode 70 and 72 and indicative of any forward-biased diode 48, 50, 52, or 54, are rendered conductive so as to provide a low resistive path for applying the voltage $V_D$, having a typical value of +1.0 volts, to the base electrode of each transistor 19 and 30, both of starting circuit 42, so that the oscillating operation of the starting circuit 42 is inhibited during this forward conductive state of diode 48, 50, 52, or 54. Conversely, the transistors 62 and 64 of interrupt means 65 in response to a voltage, such as about less than about +0.5 volts and indicative of the reversed-biased diodes 48, 50, 52, and 54, are not rendered conductive and the oscillating operation of the starting circuit 42 is enabled during these nonconductive states of diodes 48, 50, 52, and 54.

It should now be appreciated that sensing means diodes 70 and 72, in combination with interrupt means 65, adapts the operation of the starting circuit 42 to the conductive states of diodes 48, 50, 52, and 54 so that the diodes 48, 50, 52, and 54 provide the means for EMI reduction or filtering in addition to their rectifying function. The circuit arrangement 40 reduces the EMI typically generated for a factor in the order of 30%.

The EMI may be further reduced by a factor of 10% by the addition of a relatively small capacitor 46, such as 0.1 microfarads, placed across terminal L1 and L2 as shown in FIG. 2.

The circuit arrangement 40 of FIG. 2 is shown to have a resistor 56 connected across diode 48 and a resistor 58 connected across diode 52. The resistors 56 and 58 improve the operation of circuit arrangement 40 in response to the second condition, that is, when the voltage A.C. power source 44 is less than the voltage across capacitor 60. During this second condition at certain durations the value of the voltage of the A.C. power source 44 referenced to the circuit ground, shown in FIG. 2, as connected to the emitter electrode of transistor 64, is uncertain. This uncertainty is typically created by variation in leakage current of diodes 48, 50, 52, and 54. To assure that the A.C. power source 42 is more positive than the voltage across capacitor 60 by at least 0.5 volts, resistors 58 and 56 are added. These resistors 56 and 58 assure that transistors 62 and 64 are rendered nonconductive so that the starting circuit 42 is enabled to supply the inductive triggering pulses to the gas discharge tube 11. The addition of resistors 56 and 58 to circuit arrangement 40 serve their desired function but reduce the amount of EMI suppression by the diodes 48, 50, 52, and 54. A circuit arrangement 80 not having the uncertain response to the second condition of the power source 44 and not having resistors 56 and 58 is shown in FIG. 3.

Circuit arrangement 80 is similar to the previously described circuit arrangement 40 and uses the same reference number to describe the same elements of FIG. 2. The circuit 80 provides, by use of a diode 74 and resistor 76, means for sensing or detecting the current flowing from the A.C. power source 44 into the capacitor 60. The resistor 76 and diode 74 are arranged in a serial manner and connected in parallel across the previously described filter capacitor 60. The node of diode 74 and resistor 76 is connected to the conductor 63. The circuit arrangement 80 may be described with reference to the first and second conditions of the voltage of the A.C. power source 44 relative to the voltage across capacitor 60.

During the first condition, that is when the voltage of the power source 44 exceeds that of the voltage across capacitor 60, the current flows from the A.C. source 44 into capacitors 60. For this condition the cathode of diode 74 connected to conductor 63 is at approximately −0.6 volts. For this condition the transistors 62 and 64 are rendered conductive which as previously described, causes a disabling signal to be generated by interrupt means 65 onto line 67 which, in turn, is responded to by the starting circuit 42 to inhibit its generation of the conductive, inducing triggering pulses.

During the second condition, that is when the voltage of the power source is less than the voltage across capacitor 60, the current no longer flows into capacitor 60. The diode 74 is in a reverse bias condition by the reverse leakage currents of the diodes 48, 50, 52, and 54 of the rectifying means 55. For this condition the transistors 62 and 64 are not rendered conductive and the starting circuit 42 is allowed to generate its conduction, inducing triggering pulses.

The circuit arrangement 80 need not employ the resistor 76 serially arranged with diode 74. The resistor 76 may be provided if the reverse leakage current of diodes 48, 50, 52, and 54 is too low to develop the desired −0.6 volts at the cathode of diode 74. The resistor 76 assures that the voltage at the cathode is greater than −0.6 volts during the second condition in which current does not flow into capacitor 60, so that transistors 62 and 64 are rendered nonconductive during this second condition.

The circuit arrangement 80 provides for EMI filtering such that the typically generated EMI is reduced by a factor of approximately 30%.

It should now be appreciated that the present invention provides for reducing electromagnetic interference typically caused by a ballast circuit to its lowest level such that the EMI interference is not bothersome to any of the users of the improved lighting unit.

What I claim as new and desire to secure by Letters Patent of the United States is:

1. In a lighting unit having a gas discharge tube as the main light source, a filament serving as a supplementary light source and as a resistive ballast element, and a ballast circuit comprising means for coupling conduction inducing triggering pulses to said gas discharge tube, said ballast circuit being adapted to accept across its first and second input terminals an applied alternating current (A.C.) voltage, said first and second input terminals having connected thereacross rectifying means comprising four diodes arranged in a full-wave configuration and having at its output stage a filter capacitor, the improvement comprising:

control means effective for developing an output signal indicative that at least one of said diodes of said rectifying means is in a forward-biased condition, and;

interrupt means responsive to said output signal of said control means and effective for generating a disabling signal to inhibit the coupling of said conduction inducing triggering pulses to said gas discharge tube.

2. An improved lighting unit according to claim 1 wherein said control means comprises a first and second diode each having a cathode respectively connected to said first and second input terminals of said ballast circuit and an anode connected to said interrupt means.

3. An improved lighting unit according to claim 1 wherein said improvement further comprises a first and a second resistor in said rectifying means, respectively, connected across first and second diodes in said rectifying means which are forward-biased during the same portion of the cycle of said applied A.C. voltage.

4. An improved lighting unit according to claim 1 wherein said control means comprises a diode arranged in parallel manner with said filter capacitor and being further arranged with its cathode connected both to one of said input terminals and to an input terminal of said interrupt means.

5. An improved lighting unit according to claim 4 wherein said control means further comprises a resistor serially arranged with said diode across said filter capacitor.

6. An improved lighting unit according to claim 1 further comprising a capacitor coupled across the said first and second input terminals of said ballast circuit.

* * * * *